US008216321B2

(12) United States Patent
Deruelle et al.

(10) Patent No.: US 8,216,321 B2
(45) Date of Patent: Jul. 10, 2012

(54) SILICONE/FLUORINATED ORGANIC COMPOUND MIXED COMPOSITION FOR CONFERRING OLEOPHOBICITY AND/OR HYDROPHOBICITY ON A TEXTILE MATERIAL

(75) Inventors: Martial Deruelle, Mornant (FR); Yves Giraud, Sainte Foy les Lyon (FR)

(73) Assignee: Bluestar Silicones France, SAS, Lyons Cedex (FR)

( * ) Notice: Subject to any disclaimer, the term of this patent is extended or adjusted under 35 U.S.C. 154(b) by 510 days.

(21) Appl. No.: 11/547,401

(22) PCT Filed: Mar. 30, 2005

(86) PCT No.: PCT/FR2005/000767

§ 371 (c)(1),
(2), (4) Date: Aug. 15, 2007

(87) PCT Pub. No.: WO2005/095519

PCT Pub. Date: Oct. 13, 2005

(65) Prior Publication Data

US 2008/0090088 A1 Apr. 17, 2008

(30) Foreign Application Priority Data

Mar. 31, 2004 (FR) ..... 04 03386

(51) Int. Cl.
*C08L 83/04* (2006.01)
*D06B 19/00* (2006.01)

(52) U.S. Cl. ..... 8/115.51; 8/115.54; 8/147; 428/446; 524/588; 525/474

(58) Field of Classification Search ..... 8/115.51; 528/12; 428/446
See application file for complete search history.

(56) References Cited

U.S. PATENT DOCUMENTS

| | | | | |
|---|---|---|---|---|
| 5,391,680 | A * | 2/1995 | Maruyama | 528/38 |
| 5,861,459 | A * | 1/1999 | Cardinaud et al. | 524/838 |
| 6,074,747 | A * | 6/2000 | Scholz et al. | 428/352 |
| 2001/0031818 | A1 | 10/2001 | Feder et al. | |
| 2003/0144411 | A1 * | 7/2003 | Howe et al. | 524/588 |
| 2003/0157256 | A1 * | 8/2003 | Yamaguchi et al. | 427/378 |
| 2003/0215572 | A1 * | 11/2003 | Nojiri et al. | 427/294 |
| 2004/0144950 | A1 | 7/2004 | Chrobaczek et al. | |

FOREIGN PATENT DOCUMENTS

| | | | |
|---|---|---|---|
| EP | 0436327 | B1 | 7/1991 |
| EP | 1264863 | A1 | 12/2002 |
| WO | WO 98/13410 | A1 | 4/1998 |

OTHER PUBLICATIONS

EIC Structure Search, completed Feb. 26, 2009.*
International Search Report corresponding to PCT/FR 2005/000767, issued on Aug. 3, 2005, 5 pages.

* cited by examiner

*Primary Examiner* — Harold Pyon
*Assistant Examiner* — Katie L Hammer
(74) *Attorney, Agent, or Firm* — SNR Denton US LLP

(57) ABSTRACT

Crosslinkable liquid composition which can crosslink to give a hydrophobic and/or oleophobic silicone elastomer coating, comprising a polyorganosiloxane (POS) resin A exhibiting, per molecule, on the one hand, at least two different siloxyl units chosen from those of M, D, T and Q types, one of the units being a T unit or a Q unit, and, on the other hand, at least three hydrolysable/condensable groups of OH and/or $OR^1$ types, where $R^1$ is a linear or branched $C_1$ to $C_6$, preferably $C_1$ to $C_3$, alkyl radical, a system for promoting attachment B and a polyfluoroacrylate F. Use of this composition to form a silicone elastomer sheath around the constituent yarns, fibers and/or filaments of a textile material and to confer long-lasting oleophobicity and/or hydrophobicity properties.

46 Claims, No Drawings

SILICONE/FLUORINATED ORGANIC COMPOUND MIXED COMPOSITION FOR CONFERRING OLEOPHOBICITY AND/OR HYDROPHOBICITY ON A TEXTILE MATERIAL

CROSS-REFERENCE TO PRIORITY APPLICATIONS

This application claims priority under 35 U.S.C. §119 of French Application No. 0403386, filed Mar. 31, 2004, and is the National Phase of PCT/FR2005/000767, filed Mar. 30, 2005 and designating the United States, published on Oct. 13, 2005 as WO 2005/095519 A1, each hereby expressly incorporated by reference in its entirety and each assigned to the assignee hereof.

The field of the present invention is that of crosslinkable liquid compositions capable of being used to form a coating which makes it possible to contribute oleophobicity and/or hydrophobicity in a lasting manner to textile materials. The invention also relates to the use of such a composition in the treatment of these textile materials and to the treated textile materials.

Textiles are porous materials which can be easily impregnated with liquids. While this impregnation is desired in certain applications (dyeing, absorbents), it can prove to be disadvantageous for some aspects, one of them being the ability of the textile to become stained on contact with certain liquids.

When the liquid is mainly aqueous, rendering the textile hydrophobic makes it possible to limit the staining but the water-repellency does not make it possible always to limit staining by fatty substances. To prevent the fabric from becoming stained on contact with a fatty substance, it is necessary to prevent the fat from penetrating into the porous structure and wetting the fibres.

Contributing oleophobic properties to a textile makes it possible to confer on it a stain-resistant nature. This stain-resistant nature is particularly desired in applications such as, for example, clothing and fabrics for furniture and the interior of motor vehicle passenger compartments.

There exists a small number of chemical compounds which interact sufficiently little with oils and which exhibit a surface energy sufficiently low for wetting by fatty substances not to be observed. These compounds often exhibit perfluorinated groups.

In practice, the products used to confer oleophobic properties on textiles are polyfluoroacrylates, in particular those sold by DuPont de Nemours.

The main disadvantages of polyfluoroacrylates are their cost and the durability of the treatment. The loss in effectiveness over time of these treatments is attributed to phenomena of reorganization of the perfluorinated groups at the surface and to phenomena of desorption during washing operations. Problems with regard to health and the environment result therefrom, which problems become increasingly important as the amount of perfluorinated groups is increased in attempting to overcome the lack of durability.

One object of the present invention is thus to provide a formulation and a treatment which make it possible to contribute lasting oleophobicity or hydrophobicity to a large number of textile materials.

Another object of the invention is to provide a formulation and a treatment which make it possible to contribute lasting oleophobicity and lasting hydrophobicity to the textile material.

Another object of the invention is to make it possible for these properties to exhibit a degree of resistance to washing and more generally to service stresses.

Yet another object of the invention is to provide a treatment which is competitive in cost and in particular less expensive than a conventional treatment with polyfluoroacrylates.

In the present account, the expression "textile material" denotes: first, the yarns, fibres and/or filaments made of synthetic, artificial and/or natural materials which are employed in the manufacture of textile articles; and, secondly, the textile articles prepared from the said yarns, fibres and/or filaments, comprising at least one textile surface and consisting, for example, of woven, nonwoven and/or knitted articles, the said "prepared textile articles" encompassing both fabrics and clothes, such as, for example, jackets and trousers, or industrial fabrics. By extension, the expression "textile material" also denotes materials with a base texture having a fibrillar form, such as, in particular, paper and leather.

A first subject-matter of the invention is thus a crosslinkable liquid composition which can crosslink to give a hydrophobic and/or oleophobic, preferably oleophobic and hydrophobic, silicone elastomer coating and which is capable of being crosslinked on contact with a textile material (and/or with its constituent yarns, fibres and/or filaments) to form such a coating, comprising:

A—least one polyorganosiloxane (POS) resin exhibiting, per molecule, on the one hand, at least two different siloxyl units chosen from those of M, D, T and Q types, one of the units being a T unit or a Q unit, and, on the other hand, at least three hydrolysable/condensable groups of OH and/or $OR^1$ types, where $R^1$ is a linear or branched $C_1$ to $C_6$, preferably $C_1$ to $C_3$, alkyl radical;

B—least one system for promoting the attachment of the said network to the surface of the textile material comprising or composed, preferably, of:

either B-1 at least one metal alkoxide of general formula:

$$M[(OCH_2CH_2)_aOR^2]_n \quad (I)$$

in which:

M is a metal chosen from the group formed by: Ti, Zr, Ge, Si, Mn and Al;

n=valency of M;

the $R^2$ substituents, which are identical or different, each represent a linear or branched $C_1$ to $C_{12}$ alkyl radical;

a represents zero, 1 or 2;

with the conditions according to which, when the symbol a represents zero, the alkyl radical $R^2$ has from 2 to 12 carbon atoms and, when the symbol a represents 1 or 2, the alkyl radical $R^2$ has from 1 to 4 carbon atoms;

optionally the metal M is connected to one or more ligands, for example those obtained using in particular β-diketones, β-ketoesters and malonic esters (for example, acetylacetone) or triethanolamine;

or B-2 at least one metal polyalkoxide resulting from the partial hydrolysis of the monomeric alkoxides of formula (I) mentioned above in which the symbol $R^2$ has the abovementioned meaning with the symbol a representing zero;

or a combination of B-1 and B-2;

or B-3 at least one optionally alkoxylated organosilane comprising, per molecule, at least one $C_2$-$C_6$ alkenyl group (B 3/1), and/or at least one organosilicon compound comprising at least one epoxy, amino, ureido, isocyanato and/or isocyanurate radical (B 3/2);

or B-4 a combination of B-1 with B 3/1 and/or B 3/2, a combination of B-2 with B 3/1 and/or B 3/2, or a combination of B-1 and B-2 with B 3/1 and/or B 3/2;

C—optionally at least one functional additive comprising:

either C-1 at least one silane and/or at least one POS which is essentially linear and/or at least one POS resin, each of these organosilicon compounds being equipped, per molecule, on the one hand, with attaching functional group(s) (AF) capable of reacting with A and/or B or capable of generating, in situ, functional groups capable of reacting with A and/or B and, on the other hand, with hydrophobicity functional group(s) (HF);

or C-2 at least one hydrocarbonaceous compound comprising at least one saturated or unsaturated, linear or branched hydrocarbonaceous group and optionally one or more heteroatom(s) other than Si (such as, for example, an oxygen, fluorine or nitrogen atom) and existing in the form of a monomeric, oligomeric (linear, cyclic or branched) or polymeric (linear, cyclic or branched) structure, the said hydrocarbonaceous compound being equipped, per molecule, on the one hand, with attaching functional group(s) (AF) capable of reacting with A and/or B or capable of generating, in situ, functional groups capable of reacting with A and/or B and, on the other hand, with hydrophobicity functional group(s) (HF);

or a mixture of C-1 and C-2;

D—optionally at least one nonreactive additive system comprising: (i) at least one organic solvent or diluent and/or one nonreactive organosilicon compound; (2i) and/or water; and E—optionally at least one auxiliary agent other than D known to a person skilled in the art which is chosen, when required, according in particular to the applications in which the textile materials treated in accordance with the invention are employed; and F—at least one polyacrylate comprising fluorinated groups, preferably perfluorinated groups (preferably at least one fluoroacrylate polymer).

The proportion of polyacrylate can vary within wide proportions. However, it may be specified that the proportion by weight of polyacrylate to the sum of the dry components A, B and C can range from 1 to 99% by weight, in particular from 5 to 80% by weight, preferably from 10 to 60% by weight. Good results have been obtained with approximately 50, 40 and 20% by weight.

According to one embodiment, the composition comprises at least constituents A, B, D and F.

According to another embodiment, the composition comprises at least constituents A, B, C, D and F.

According to another embodiment, the composition comprises at least constituents A, B, C and F.

In each of the various combinations possible, the amounts of the constituents A to E employed can be as follows (the parts are given by weight):

per 100 parts of constituent A, from 0.5 to 200, preferably from 0.5 to 100 and more particularly from 1 to 70 parts of constituent B, per 100 parts of constituent A, from 0 to 1000, preferably from 1 to 1000 and more preferably from 1 to 300 parts of constituent C, per 100 parts of constituent A, from 0 to 10 000, preferably from 1 to 10 000 and better still from 1 to 5000 parts of constituent D, and/or per 100 parts of constituent A, from 0 to 100 parts of constituent E.

Polyfluoroacrylates, which can be homopolymers or copolymers, are compounds fully known to a person skilled in the art. In the context of the invention, use may be made of the various polyfluoroacrylates normally employed in the field of oleophobicity. Use may be made, for example, of compounds disclosed in WO-A-01/18140, WO-A-01/44339, WO-A-01/36526, WO-A-99/65959, U.S. Pat. No. 5,344,903, EP-A-234 724, U.S. Pat. No. 4,366,299 and U.S. Pat. No. 6,074,436.

Preferably, the polyfluoroacrylate comprises at least one polymer chain unit derived from a fluoroalkyl, preferably perfluoroalkyl, (meth)acrylate monomer; the polymer thus preferably comprises at least one unit Z: $—C(=O)—O—(CH_2)_n—(CF_2)_m—CF_3$, with n between 0 and 15, preferably from 1 to 10, better still from 1 to 4, more preferably 2, and m between 0 and 20, preferably between 1 and 20, better still between 2 and 20, more preferably between 3 and 12. Conventionally, the polyacrylate can comprise Z groups exhibiting various values of n within the abovementioned ranges. According to a preferred form, the polyacrylate comprises Z groups exhibiting values of n of between 3 and 12 (throughout the description, the limits of the ranges are included).

The polyacrylate can also additionally comprise at least one polymer chain unit derived from an alkyl (meth)acrylate monomer; the polymer can thus additionally comprise at least one unit Y: —C(=O)—O-(alkyl), with alkyl representing a linear, branched or cyclic alkyl having from 1 to 25 C, preferably from 1 to 9 C; preferably, at least one unit Y': $—C(=O)—O—(CH_2)_p—CH_3$, with p between 0 and 24, preferably between 1 and 15, better still between 1 and 8.

As is known per se, the polyacrylate can comprise one or more polymer chain units derived from a (meth)acrylate monomer carrying one or more polar groups X; thus, the polymer can comprise one or more other units, for example one or more polar groups X, such as, for example, amine, quaternary amine, alcohol or carboxylate (e.g., alkyl carboxylate) groups or an anionic group (e.g., anionic carboxylate, anionic alkoxide) having a counterion of ammonium, alkylammonium or alkali metal, in particular Na or K, type, and the like.

According to one form of the invention, use may be made of at least one polyfluoroacrylate comprising, in any order, the repeat units appearing in the following formula (F):

$$—(CH_2—CRZ)_a—(CH_2—CRY)_b—(CH_2—CRX)_c—$$

in which Z, Y and X are as defined above, R is H or $CH_3$, and a, b and c are integers such that a is greater than or equal to 1 while c and d are each, independently of one another, greater than or equal to 0.

The molecular weight of these fluoropolymers can vary within wide proportions, as is usually found. However, it may be specified that the molecular weight can be between 50 and 1 000 000.

The fluoropolymer can be provided in various forms and in particular (i) either in a appropriate solvent, (2i) or as an emulsion or as a dispersion with an aqueous phase. Thus, according to the form selected, the composition according to the invention can comprise, as additive D, (i) at least one organic solvent or diluent and/or one nonreactive organofluorinated compound; or (2i) water, at least one organic solvent or diluent and/or one nonreactive organofluorinated compound and optionally at least one nonionic, ionic or amphoteric surfactant.

The conventional organic solvents which can act as diluent can be:

chlorinated solvents, such as trichloroethylene, trichloroethane, perchloroethylene, perchloroethane or dichloromethane;

alkanols, such as ethanol, isopropanol, butanol or octanol;

aliphatic ketones, such as acetone, methyl ethyl ketone or methyl butyl ketone, and cycloaliphatic ketones, such as cyclopentanone or cyclohexanone;

esters of nonfatty carboxylic acids and of alkanols, such as ethyl acetate, butyl acetate or pentyl acetate;

esters derived from saturated $C_{10}$ to $C_{16}$, preferably $C_{12}$ to $C_{14}$, fatty acids and from alkanols, such as myristates ($C_{14}$), laurates ($C_{12}$) and mixtures;

ethers, such as dibutyl ether, diisopropyl ether, ethylene glycol monomethyl ether, ethylene glycol monoethyl ether, diethylene glycol monoethyl ether or diethylene glycol monobutyl ether.

By way of example, the polyacrylates can be produced according to the process for synthesis by telomerization of Atofina, which makes it possible to obtain, from tetrafluoroethylene, perfluorinated chains $C_nF_{2n+1}$ comprising, on average, at least 8 carbon atoms and 17 fluorine atoms. These perfluorinated chains are subsequently functionalized at one of their ends by an alcohol functional group and then grafted to an acrylic monomer structure by a simple esterification reaction. The other functional groups described above are also grafted to an acrylic monomer and the polymerization of the latter makes it possible to obtain highly varied fluorinated acrylic resin structures.

The crosslinkable liquid composition according to the invention makes it possible:

by crosslinking around the constituent yarns, fibres and/or filaments of the textile material, to provide a broad protective coverage of the textile material, which protection is not very dependent on the nature of the said material because it requires few or no anchoring points;

by forming a chemically crosslinking silicone sheath, to provide long-lasting protection of the textile material by conferring thereon excellent resistance with regard to the attacks encountered during use: the expression "long-lasting protection" is understood to define protection, on the one hand, with regard to the restrictions imposed by textile processes, such as in particular heat-setting heat treatments or dyeing treatments, and, on the other hand, with regard to attacks experienced during the life of the textile material (for example an item of clothing), such as, in particular, abrasion while being worn, washing operations in a detergent aqueous medium or dry cleaning in a solvent medium;

to form coatings having oleophobicity and hydrophobicity properties; and due to the special nature of the constituents of the formulation, to carry out the operations of depositing the liquid formulation and of crosslinking it at any point in the processes for preparing and/or restoring and/or maintaining the textile material.

Thus, by virtue of the use of this composition, a functional siloxane network is attached on a long-lasting basis to the textile surface and the treatment thus carried out makes it possible to successfully obtain the various advantageous properties mentioned above. The hydrophobicity is conferred by the silicone coating and the oleophobicity by the polyfluoroacrylate. However, it has been observed that the combination of the silicone formulation and of the polyfluoroacrylate results in a long-lasting oleophobic and hydrophobic coating and that, in order to confer a given level of oleophobicity, the amounts of polyacrylate to be made use of can be much lower than those which are necessary when the polyacrylate is used alone. It is possible to adjust the levels of oleophobicity by varying the proportion of the fluorinated groups contributed by the polyacrylate.

In addition, it has also been observed that, in some cases, the treatment carried out with the silicone formulation not only does not in any way impede the subsequent dyeing of the textile material but can also create an effect of improving the fastness of the colours with regard to washing operations.

A second subject-matter of the present invention is the use of the compositions according to the invention in treating a textile material and conferring thereon long-lasting oleophobicity and/or hydrophobicity properties. According to a preferred form, this treatment confers long-lasting oleophobicity and hydrophobicity properties on the textile material.

The longevity can be assessed by comparing the oil resistance properties, for the oleophobicity, and the debeading properties, for the hydrophobicity, before and after washing the treated material. The example presented below describes a process for washing in the presence of detergent and in a washing machine, the measurement of the beading effect by the spray-test AATCC Test Method 22-1996 and the measurement of oil resistance by the test AATCC Test Method 118-1997. It is obvious that other washing tests, in the presence or absence of detergent, might easily be developed.

According to the invention, the beading effect obtained preferably corresponds to a grade of 4, better still to a grade of 5. The term "longevity of this effect" is understood to mean that, preferably, after the washing treatment, the grade remains greater than or equal to 3.

According to the invention, the oil resistance preferably corresponds to a grade of between 3 and 8. The term "longevity of this resistance" is understood to mean that, preferably, after the washing treatment, the grade remains between 3 and 8.

As regards the silicone formulation proper, the constituents A which can be used, separately or as a mixture, are advantageously conventional film-forming resins, among which may be mentioned:

A-1: at least one organosilicon resin prepared by cohydrolysis and cocondensation of chlorosilanes chosen from the group composed of those of formulae $(R^3)_3SiCl$, $(R^3)_2Si(Cl)_2$, $R^3Si\ (Cl)_3$ and $Si(Cl)_4$. These resins are branched organopolysiloxane oligomers or polymers which are well known and commercially available. They exhibit, in their structure, at least two different siloxyl units chosen from those of formula $(R^3)_3SiO_{0.5}$ (M unit), $(R^3)_2SiO$ (D unit), $R^3SiO_{1.5}$ (T unit) and $SiO_2$ (Q unit), at least one of these units being a T or Q unit. The $R^3$ radicals are distributed so that the resins comprise approximately 0.8 to 1.8 $R^3$ radicals per silicon atom. Furthermore, these resins are not completely condensed and they still have approximately from 0.001 to 1.5 OH and/or $OR^1$ alkoxyl groups per silicon atom.

The $R^3$ radicals are identical or different and are chosen from $C_1$-$C_6$ alkyl radicals which are linear or branched, $C_2$-$C_4$ alkenyl radicals, the phenyl radical or the 3,3,3-trifluoropropyl radical. Mention may be made, for example, as $R^3$ alkyl radicals, of the methyl, ethyl, isopropyl, tert-butyl and n-hexyl radicals.

Mention may be made, as examples of branched organopolysiloxane oligomers or polymers, of MQ resins, MDQ resins, TD resins and MDT resins, it being possible for the OH and/or $OR^1$ groups to be carried by the M, D and/or T units, the content by weight of OH and/or $OR^1$ groups being between 0.2 and 10% by weight.

A-2: at least one mixed resin prepared by cocondensation of the organosilicon resins A-1 mentioned above with conventional organic polymers, such as: polyester and alkyd resins which are or are not modified by fatty acids, such as oleic, linoleic or ricinoleic acid, or esters of fatty acids and of aliphatic polyols, such as castor oil or tallow; epoxide resins which are or are not modified by fatty acids; phenolic, acrylic or melamine-formaldehyde resins; polyamides; polyimides; polyamideimides; polyureas; polyurethanes; polyethers; polycarbonates; or polyphenols.

Mention may be made, as concrete examples of constituents A which are preferred, of the mixtures A-3:

of at least one resin of A-1 type (resin A-1/1) exhibiting, in its structure, at least two different siloxyl units chosen from those of formula $(R^3)_3SiO_{0.5}$ (M unit), $(R^3)_2SiO$ (D unit) and $R^3SiO_{1.5}$ (T unit), at least one of these units being a T unit, it being possible for the OH and/or $OR^1$ groups to be carried by the M, D and/or T units and the content by weight of OH and/or $OR^1$ groups being between 0.2 and 10% by weight, and of at least one other resin of A-1 type (resin A-1/2) exhibiting, in its structure, at least two different siloxyl units chosen from those of formula $(R^3)_3SiO_{0.5}$ (M unit), $(R^3)_2SiO$ (D unit) and $R^3SiO_{1.5}$ (T unit) and $SiO_2$ (Q unit), at least one of these units being a Q unit, it being possible for the OH and/or $OR^1$ groups to be carried by the M, D and/or T units and the content by weight of OH and/or $OR^1$ groups being between 0.2 and 10% by weight.

Mention may be made, as concrete examples of constituents A which are highly suitable, of the mixtures A-3:

of at least one hydroxylated MDT resin having a content by weight of OH groups of between 0.2 and 10% by weight, and of at least one hydroxylated MQ resin having a content by weight of OH groups of between 0.2 and 10% by weight.

In the mixtures A-3, the respective proportions of the constituents are not critical and can vary within wide proportions. These mixtures comprise, for example, 60 to 90% by weight of resin(s) A-1/1 and 40 to 10% by weight of resin(s) A-1/2.

As regards the constituents B-1, mention may be made, as examples of $R^2$ in the organic derivatives of the metal M of formula (I), of the methyl, ethyl, propyl, isopropyl, butyl, isobutyl, hexyl, 2-ethylhexyl, octyl, decyl and dodecyl radicals.

Mention may be made, as concrete examples of constituents B-1 which are preferred, of: alkyl titanates, such as ethyl titanate, propyl titanate, isopropyl titanate, butyl titanate, 2-ethylhexyl titanate, octyl titanate, decyl titanate, dodecyl titanate, β-methoxyethyl titanate, β-ethoxyethyl titanate, β-propoxyethyl titanate or the titanate of formula $Ti[(OCH_2CH_2)_2OCH_3]_4$; alkyl zirconates, such as propyl zirconate or butyl zirconate; alkyl silicates, such as methyl silicate, ethyl silicate, isopropyl silicate or n-propyl silicate; and mixtures of these products.

Mention may be made, as concrete examples of polyalkoxides B-2 which are preferred, originating from the partial hydrolysis of monomeric titanates, zirconates and silicates, of: the polytitanates B-2 originating from the partial hydrolysis of isopropyl, butyl or 2-ethylhexyl titanates; the polyzirconates B-2 originating from the partial hydrolysis of propyl and butyl zirconates; the polysilicates B-2 originating from the partial hydrolysis of ethyl and isopropyl silicates; and mixtures of these products.

Mention may be made, as concrete examples of constituents B-3/1 which are preferred, of optionally alkoxylated organosilanes chosen from the products of following general formula:

(B-3/1)

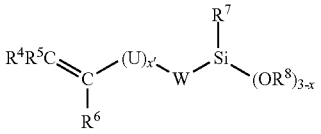

in which:

$R^4$, $R^5$ and $R^6$ are hydrogens or hydrocarbonaceous radicals which are identical to or different from one another and preferably represent hydrogen, a linear or branched $C_1$-$C_4$ alkyl or a phenyl optionally substituted by at least one $C_1$-$C_3$ alkyl, U is a linear or branched $C_1$-$C_4$ alkylene or a divalent group of formula —CO—O-alkylene- where the alkylene residue has the definition given above and the right-hand free valency (in bold) is connected to the Si via W, W is a valency bond, $R^7$ and $R^8$ are identical or different radicals and represent a linear or branched $C_1$-$C_4$ alkyl, x'=0 or 1, x=0 to 2, preferably 0 or 1 and more preferably still 0.

Without this being limiting, vinyltrimethoxysilane or γ-(meth)acryloyloxypropyltrimethoxysilane can be regarded as a particularly appropriate compound B-3/1.

Mention may be made, as concrete examples of constituents B-3/2 which are preferred, of tris[(trialkoxysilyl)alkyl] isocyanurates, where the alkyl groups comprise from 1 to 4 carbon atoms, and organosilicon compounds chosen:

either from the products B-3/2-a corresponding to the following general formula:

(B-3/2-a)

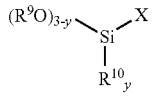

in which:

$R^9$ is a linear or branched $C_1$-$C_4$ alkyl radical, $R^{10}$ is a linear or branched alkyl radical, y is equal to 0, 1, 2 or 3, preferably to 0 or 1, and more preferably still to 0, where X has the meaning:

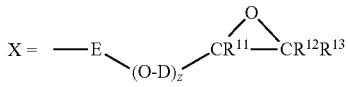

with:

E and D, which are identical or different radicals chosen from linear or branched $C_1$-$C_4$ alkyls, z, which is equal to 0 or 1, $R^{11}$, $R^{12}$ and $R^{13}$, which are identical or different radicals representing hydrogen or a linear or branched $C_1$-$C_4$ alkyl, hydrogen being more particularly preferred, it being possible for $R^{11}$ and $R^{12}$ or $R^{13}$ alternatively to form, together and with the two carbons carrying the epoxy, an alkyl ring having from 5 to 7 ring members, or from the products B-3/2-b composed of epoxyfunctional polydiorganosiloxanes comprising:

(i) at least one siloxyl unit of formula:

(B-3/2-b)

$$X_pG_qSiO_{\frac{4-(p+q)}{2}}$$

in which:

X is the radical as defined above for the formula (B-3/2-a),

G is a monovalent hydrocarbonaceous group which does not have an unfavourable effect on the activity of the catalyst and which is preferably chosen from alkyl groups having from 1 to 8 carbon atoms inclusive, optionally substituted by at least one halogen atom, advantageously chosen from the methyl, ethyl, propyl and 3,3,3-trifluoropropyl groups, and from aryl groups and advantageously from the xylyl and tolyl and phenyl radicals, p=1 or 2, q=0, 1 or 2, p+q=1, 2 or 3, and (2i) optionally at least one siloxyl unit of formula:

$$G_rSiO_{\frac{4-r}{2}} \quad \text{(B-3/2b)}$$

in which G has the same meaning as above and r has a value of between 0 and 3, for example between 1 and 3.

The compounds B-3/2 are preferably tris[3-(trimethoxysilyl)propyl]isocyanurates and epoxyalkoxymonosilanes B-3/2-a.

Mention may be made, as examples of such compounds B-3/2-a, of:

3-glycidoxypropyltrimethoxysilane (GLYMO)

3,4-epoxycyclohexylethyltrimethoxysilane.

For the implementation of the invention, use is more preferably made, as constituent B, of the following titanates, zirconates and silicates B-1, taken alone or as a mixture with one another: ethyl titanate, propyl titanate, isopropyl titanate, butyl (n-butyl) titanate, propyl zirconate, butyl zirconate, ethyl silicate, propyl silicate and isopropyl silicate.

When B-1+B-3/1 or B-1+B-3/2 is used, the proportions by weight of B-1 with respect to the B-1+B-3/1 or B-3/2 total are in particular from 5 to 100%, preferably from 8 to 80%.

Quantitatively, when B-1+B-3/1+B-3/2 is used, it may be specified that the proportions by weight between B-1, B-3/1 and B-3/2, expressed as percentages by weight with respect to the total of the three, are as follows:

B-1≧1, preferably between 5 and 25,

B-3/1≧10, preferably between 15 and 70,

B-3/2≦90, preferably between 70 and 15, it being understood that the sum of these proportions of B-1, B-3/1 and B-3/2 is equal to 100%.

The constituent C comprises functional groups which allow it to be attached to the silicone sheath and HF functional groups which confer hydrophobicity properties on the treated textile material.

The constituents C-1 which can be used, separately or as a mixture, are silanes, POSs, which are essentially linear, and POS resins carrying, in their molecules, attached to silicon atoms, the two functionalities AF and HF.

The AF functional groups are more specifically condensable/hydrolysable functional groups corresponding to OH and/or $OR^1$ or functional groups capable of generating, in situ, OH and/or $OR^1$ functional groups.

The FH functional groups may comprise any known hydrophobic group or any combination of known hydrophobic groups. Preferably, these groups are chosen from the following forms: alkyl groups, silicone groups, fluorinated groups and their various combinations. These groups may in addition develop properties of softness.

According to a preferred form, these groups are siloxane sequences comprising M, D and/or T units, preferably those defined above with respect to the constituents A-1.

According to another form, these groups are linear or branched $C_1$ to $C_{50}$, in particular $C_1$ to $C_{30}$, alkyl sequences.

According to yet another form, these groups are fluorinated groups of general formula:

$$—Z—(—R^F)_k$$

in which:

Z represents a divalent or trivalent linking unit of hydrocarbonaceous nature which can be linear or branched, a saturated or unsaturated aliphatic, aromatic or mixed aliphatic/aromatic, cyclic or noncyclic residue, and which can include one or more oxygenated heteroatoms comprising from 1 to 30 carbon atoms, k is 1 or 2, $R^F$ represents the $—C_5F_{2s}—CF_3$ group with s equal to or different from zero or the $C_sF_{2s}H$ group with s equal to or greater than 1.

Mention may be made, as concrete examples of constituents C-1 which are preferred, of the organosilicon compounds listed below:

(i) essentially linear diorganopolysiloxanes comprising a hydroxyl group at each chain end, of formula:

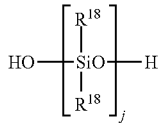

(III)

in which:

the $R^{18}$ substituents, which are identical or different, each represent a saturated or unsaturated, substituted or unsubstituted, aliphatic, cyclanic or aromatic monovalent $C_1$ to $C_{13}$ hydrocarbonaceous radical;

j has a value sufficient to confer, on the diorganopolysiloxanes of formula (III), a dynamic viscosity at 25° C. ranging from 50 to 10 000 000 mPa·s;

it should be understood that, in the context of the present invention, it is possible to use, as hydroxylated POSs of formula (III), a mixture composed of several hydroxylated polymers which differ from one another by the value of the viscosity and/or the nature of the substituents bonded to the silicon atoms; it should further be understood that the POSs of formula (III) can optionally comprise T units of formula $R^{18}SiO_{3/2}$ and/or $SiO_2$ units in the proportion of at most 1% (these percentages expressing the number of T and/or Q units per 100 silicon atoms);

(ii) hydroxylated POS resins comprising, in their structure, T and optionally M and/or optionally D siloxyl units as defined above with respect to the resins A-1;

(iii) hydroxylated POS resins obtained in particular:

by hydrolysis of an alkoxysilane S substituted by HFs; it can relate, for example, to an HF-substituted trialkoxysilane, which makes it possible to obtain a hydroxylated resin comprising T units, also referred to as T(OH) resin;

by homocondensation of hydrolysed silanes S;

and by stripping (entrainment with steam) the hydrolysates deriving from the HFs;

(iv) mixtures of at least two of the abovementioned organosilicon compounds.

Mention may be made, as concrete examples of constituents C-1 which are highly suitable, of hydroxylated MDT resins having a content by weight of OH groups of between 0.2 and 10% by weight, taken alone or as a mixture with hydroxylated silicone oils of formula (III).

With regard to the proportions in which the constituents C-1 are employed, they lie, as explained above, within the range from 1 to 1 000 parts by weight of constituent C-1, depending on the desired HF, per 100 parts by weight of constituent A. For example, in the case where the HF introduces hydrophobicity, from 2 to 30 parts by weight of constituent C-1 are then generally used.

As emerges from the definitions given above, in the case where the constituent A is a POS resin equipped with T and optionally M and/or optionally D unit(s), it should be understood that this resin can then also act as water repellency functional additive C-1, provided that it is used in sufficient proportions equal to the sum of the proportions corresponding to the combination A+C-1.

The constituents C-2 which can be used, separately or as a mixture, are hydrocarbonaceous compounds carrying, in their molecule, attached to carbon atoms, the two AF and HF functionalities.

The AF functional groups are more specifically condensable/hydrolysable functional groups corresponding to OH and/or $OR^1$ or functional groups capable of generating, in situ, OH and/or $OR^1$ functional groups.

Mention may be made, as concrete examples of constituents C-2 which are preferred, of fluorinated alcohols, preferably perfluorinated alcohols, of formula:

$$R^{19}—OH \quad (IV)$$

where $R^{19}$ represents a linear or branched aliphatic radical having from 2 to 20 carbon atoms, the said carbon atoms being substituted by at least one fluorine atom and optionally by at least one or hydrogen atom.

Mention may be made, as concrete examples of constituents C-2 which are highly suitable, of perfluorinated alcohols of formula $R^F—(CH_2)_m—OH$, where $R^F$ is as defined above and m is a number ranging from 0 to 10.

With regard to the proportions in which the constituents C-2 are employed, they lie, as explained above, within the range from 1 to 1 000 parts by weight of constituent C-2 per 100 parts by weight of constituent A.

The constituent or constituents D comprise the compounds made necessary by the use of the silicone formulation and of the polyacrylate and/or in order to suitably dilute the composition in order to make possible the application of the composition to the textile. The composition can, for example, comprise a constituent D, in particular a solvent, which promotes mixing between the silicone formulation proper and the polyacrylate or the polyacrylate formulation. Mention may be made, as concrete examples of optional constituents D which are preferred, of, in addition to water, the compounds listed below:

- conventional organic solvents, some of which can act as diluents, chosen from the group consisting of:
  - aliphatic solvents having from 5 to 20 carbon atoms, such as hexane, heptane, white spirit, octane or dodecane, and cycloaliphatic solvents, such as cyclohexane, methylcyclohexane or decalin;
  - chlorinated solvents, such as trichloroethylene, trichloroethane, perchloroethylene, perchloroethane or dichloromethane;
  - aromatic solvents, such as toluene or xylene;
  - alkanols, such as ethanol, isopropanol, butanol or octanol;
  - aliphatic ketones, such as acetone, methyl ethyl ketone or methyl butyl ketone, and cycloaliphatic ketones, such as cyclopentanone or cyclohexanone;
  - esters of nonfatty carboxylic acids and of alkanols, such as ethyl acetate, butyl acetate or pentyl acetate;
  - esters derived from saturated $C_{10}$ to $C_{16}$, preferably $C_{12}$ to $C_{14}$, fatty acids and from alkanols, such as myristates ($C_{14}$), laurates ($C_{12}$) and mixtures;
  - ethers, such as dibutyl ether, diisopropyl ether, ethylene glycol monomethyl ether, ethylene glycol monoethyl ether, diethylene glycol monoethyl ether or diethylene glycol monobutyl ether;
- nonreactive linear diorganopolysiloxanes of formula:

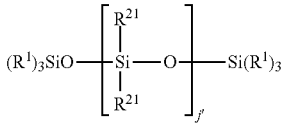

(VI)

in which:

- the $R^{21}$ constituents, which are identical or different, have the same meanings as those given above for the reactive diorganopolysiloxane of formula (III);
- j' has a value sufficient to confer, on the polymers of formula (VI), a dynamic viscosity at 25° C. ranging from 10 to 200 000 mPa·s;

POS resins having the same meanings as those given above for the constituent A but which are devoid, this time, of any functional group of OH and/or $OR^1$ types.

Mention may be made, as concrete examples of resins which can be used, of MQ, MDQ, TD and MDT resins.

Mention may be made, as concrete examples of optional auxiliary constituents E which are preferred, of the compounds listed below:

- polycondensation catalysts which are compounds of a metal generally chosen from tin, titanium and zirconium; it is thus possible to use tin monocarboxylates and dicarboxylates, such as tin 2-ethylhexanoate, dibutyltin dilaurate, dibutyltin diacetate, hexacoordinated tin(IV) chelates, and the like, such as those described in EP-A-0 367 696;
- appropriate fillers, among which will in particular be mentioned:
  - metal powders, such as zinc powder, aluminium powder or magnesium powder;
  - oxides, such as silica, ground quartz, alumina, zirconium, titanium, zinc or magnesium oxide or iron, cerium, lanthanum, praseodymium or neodymium oxides;
  - silicates, such as mica, talc, vermiculite, kaolin, feldspar or zeolites;
  - calcium carbonate, barium metaborate, iron, zinc or calcium pyrophosphates, zinc phosphate or carbon black;
  - pigments, such as phthalocyanines, chromium oxides, cadmium sulphide and cadmium sulphoselenides;
  - crosslinked or noncrosslinked organic or polymeric particles;
- fungicides or bactericides known to a person skilled in the art;
- thixotropic agents known to a person skilled in the art;
- and, in the case of the use of a crosslinkable liquid silicone formulation as an aqueous dispersion or emulsion, nonionic, ionic or amphoteric surface-active agents.

The liquid silicone formulations used in the context of the present invention as textile coating bases are prepared by simple mixing at ambient temperature, and in any order of introduction, of the constituents A, B, C, D (optional) and E (optional). The amounts involved are defined as indicated above.

The constituents can be incorporated in any order but, however, it is preferable, to avoid any risk of precipitation of solid products or of formation of gel, to add the constituent A in the form of a solution in the solvent/diluent constituent D or in the form of an aqueous emulsion/dispersion, when the constituent D comprises water.

The introduction and the intimate mixing of the optional fillers E, when they are used, with the constituents A, B, C and optionally D are carried out using conventional processes employed by manufacturers of textile formulations. Pebble mills or turbo mixers, for example, can be used for the mixing.

The polyacrylate part is very often presented in the form of a solution of polyfluoroacrylate in one of the solvents mentioned above or in the form of an emulsion of this same polyfluoroacrylate.

The final composition can be prepared by simple mixing of the silicone formulation proper and of the polyfluoroacrylate composition. A third solvent can be used to facilitate the mixing.

The compositions according to the invention exhibit the advantage of curing by simple drying in the air for a period of time which can range from a few tens of minutes to several hours or, if need be, several tens of hours. This period of time can be accelerated by heating at a temperature lying within the range from 50° C. to 180° C.

The compositions according to the invention have an excellent stability on storage and can be employed in all textile applications requiring the presence, after curing, of long-lasting coatings possessing very good physical characteristics.

According to one advantageous characteristic, the compositions according to the invention can be prepared in the concentrated form (for example, from 0 to 100 parts of constituent D are used per 100 parts by weight of constituent A) and can then subsequently be diluted at the time of their use with an organic diluent, an organic solvent or water, in the proportion of 1 to 30 parts by weight of formulation per 100 parts by weight of solvent, diluent or water.

Preferably, the amount of composition according to the invention deposited on the textile article corresponds to an amount of between 0.1 and 20% by weight with respect to the weight of the dry treated textile article.

According to a first general treatment form, the use in accordance with the present invention can be implemented directly on textile articles prepared from yarns, fibres and/or filaments, comprising at least one textile surface and composed, for example, of woven, nonwoven and/or knitted articles, the use being implemented at any point in the processes for preparing (for fabrics) and/or restoring and/or maintaining (for clothes) the textile material.

The term "textile surface" is understood to mean a surface obtained by assembling yarns, fibres and/or filaments by any process, such as, for example, adhesive bonding, felting, weaving, braiding, flocking or knitting.

The yarns, fibres and/or filaments which are used for the manufacture of these textile articles can result from the conversion of a synthetic thermoplastic matrix composed of at least one thermoplastic polymer chosen from the group consisting of: polyamides, polyolefins, poly(vinylidene chloride)s, polyesters, polyurethanes, acrylonitriles, (meth) acrylate/butadiene/styrene copolymers, their copolymers and their blends. The thermoplastic matrix can comprise additives, such as pigments, delustrants, mattifying agents, catalysts, heat and/or light stabilizers, or bactericidal, fungicidal and/or acaricidal agents. It can, for example, be a mattifying agent, for example chosen from titanium dioxide particles and/or zinc sulphide particles.

The yarns, fibres and/or filaments can also result from natural materials, such as, in particular, cotton, flax or wool, according to conversion processes known to a person skilled in the art. Of course, mixtures of synthetic and natural materials can be used.

In the use according to the present invention, to apply the composition to the article to be treated, use is made of conventional techniques of the textile industry, in particular by resorting to the impregnation technique referred to as padding. Alternative techniques can also be employed, such as the techniques known under the name of lick-roll applicator, or very simply by spraying.

When the textile article is treated with a formulation comprising an organic diluent or solvent, it is desirable to subsequently remove the diluent or solvent, for example to subject this article to a heat treatment in order to drive off the diluent or the solvent in the form of vapour.

According to a second general treatment form, the yarns, fibres and/or filaments can also be brought into contact with the composition according to the invention at any point in the processes for preparing the textile material.

The term "yarn" is understood to mean, for example, a continuous multifilament object, a continuous yarn obtained by assembling several yarns or a continuous spun yarn of fibres, obtained from fibres of a single type, or from a mixture of fibres. The term "fibre" is understood to mean, for example, a short or long fibre, a fibre intended to be worked in spinning or for the manufacture of nonwoven articles or a tow intended to be cut to form short fibres.

The process for the manufacture of yarns, fibres and/or filaments generally begins by passing the thermoplastic matrix through a die and finishes before the stage of manufacturing the textile surface.

The process for the manufacture of yarns, fibres and/or filaments comprises in particular a spinning stage. The term "spinning stage" is understood to mean a specific operation consisting of the production of yarns, fibres and/or filaments. The spinning stage begins during the passage of the thermoplastic matrix through one or more dies and finishes by the transfer of the yarns, fibres and/or filaments obtained onto a bobbin (for the yarns or filaments) or into a pot (for the fibres), also referred to as winding up. The spinning stage can also comprise stages which are carried out between the stage of passing into the die and the stage of the winding process. These stages can, for example, be stages of sizing, of recombining the filaments (via one or more pick-up points or convergence guides), of drawing, of reheating the filaments, of relaxing and of heat setting.

Thus, the deposition, on the yarns, fibres and/or filaments, of the composition in accordance with the present invention can be carried out, for example, after the convergence of the yarns, fibres and/or filaments and/or during a stage of drawing the yarns, fibres and/or filaments. The said deposition can also be carried out between these two stages. Preferably, the composition is deposited on the yarns, fibres and/or filaments during the sizing stage.

According to another preferred subject-matter of the invention, a sizing composition comprising at least one composition in accordance with the present invention is deposited on the yarns, fibres and/or filaments.

The composition in accordance with the present invention can also be deposited on the yarns, fibres and/or filaments during a treatment stage during the taking up of the yarns, fibres and/or filaments. The term "treatment stage" is understood to mean treatment stages after taking up the yarns, fibres and/or filaments, such as, for example, texturing, drawing, drawing-texturing, sizing, relaxing, heat-setting, twisting, setting, crimping, washing and/or dyeing stages. In particular, a composition in accordance with the present invention can be deposited on the yarns, fibres and/or filaments during an operation chosen from the group consisting of: relaxing, twisting, setting, crimping, drawing and/or texturing the yarns, fibres and/or filaments.

A sizing composition comprising at least one composition in accordance with the present invention can also be deposited on the yarns, fibres and/or filaments, in particular during a treatment stage during the taking up of the yarns, fibres and/or filaments.

The yarns, fibres and/or filaments can also be placed in a washing and/or dyeing composition comprising at least one composition in accordance with the present invention.

According to a third general treatment form, the use in accordance with the present invention can be implemented in two steps:

- in a first step: by bringing the yarns, fibres and/or filaments into contact with the composition at any point in the processes for preparing the textile material; then
- in a second step: by bringing the textile articles prepared from the treated yarns, fibres and/or filaments into contact with the composition, the contacting operation being carried out at any point in the processes for preparing (for fabrics) and/or restoring and/or maintaining (for clothes) the textile material.

The treatment with the composition can be applied either partially or completely, on the one hand to the yarns, fibres and/or filaments and then, on the other hand, to the textile articles prepared from the treated yarns, fibres and/or filaments.

The expression "partially" is intended to define in particular an application which consists in treating the yarns, fibres and/or filaments with a portion of the constituent ingredients of the composition and in introducing the remainder during the treatment of the textile articles prepared from the treated yarns, fibres and/or filaments. For example, the system for promoting the attachment (constituent B) can be introduced during the treatment of the yarns, fibres and/or filaments, whereas the system for creating a network (constituent A) and the functional additive (constituent C) are introduced during the treatment of the articles.

The expression "completely" is intended to define an application where, on the one hand, the yarns, fibres and/or filaments and then, on the other hand, the textile articles prepared from these yarns, fibres and/or filaments are treated, each time, with a composition comprising all its constituent ingredients, with the possibility that the latter are not necessarily present in the same proportions during the treatment of the yarns, fibres and/or filaments and then during the treatment of the articles.

It will also be specified that it is possible to carry out one or more depositions of the composition (taken in all or in part) on the yarns, fibres and/or filaments and/or on the textile articles.

A further subject-matter of the present invention is the textile articles, textile materials and yarns, fibres and/or filaments for a textile material coated with a silicone elastomer obtained by crosslinking a composition according to the invention.

The invention will now be described in more detail with the help of embodiments taken as non-limiting examples.

EXAMPLES

1) Fluorinated compound (Pf):

Polyfluoroacrylate sold by DuPont de Nemours under the commercial reference FORAPERLE® F225. This polyfluoroacrylate is presented in the form of a solution in a solvent (n-butyl acetate) comprising approximately 30% on a dry basis of polyacrylate.

2) Crosslinkable liquid silicone formulation according to the invention (F1):

It has the following composition (the parts are given by weight):

A: mixture of:

- hydroxylated MDT resin having 0.5% of OH by weight and composed of 62% by weight of $CH_3SiO_{3/2}$ units, 24% by weight of $(CH_3)_2SiO_{2/2}$ units and 14% by weight of $(CH_3)_3SiO_{1/2}$ units: 57 parts; and of
- hydroxylated MQ resin having 2% of OH by weight and composed of 45% by weight of $SiO_{4/2}$ units and 55% by weight of $(CH_3)_3SiO_{1/2}$ units: 7 parts;

B: mixture of:

- n-butyl (Bu) titanate of formula $Ti(OBu)_4$: 2 parts; and of
- ethyl (Et) silicate of formula $Si(OEt)_4$: 4 parts;

D: white spirit: 30 parts.

It is rediluted in the white spirit before application, at the rate of a concentration of 15% by weight of A+B.

3) Crosslinkable liquid silicone formulation according to the invention (F2):

Mixture of 80 parts of F1 and of 20 parts of a hydroxylated gum C having of the order of 0.01% of OH by weight and composed to 100% by weight of $(CH_3)_2SiO_{2/2}$ units, having a viscosity of 4 000 000 mPa·s.

The mixture is rediluted in the white spirit before application, at the rate of a concentration of 15% by weight of A+B+C.

3) Test of the oleophobicity

- The treated textile used is a woven textile made of polyamide-6,6 and elasthane (80/20). It is composed of elastic yarns in warp and weft based on an elasthane, 44 dtex, covered with some PA-6,6, 44 dtex/34 strands. These textile surfaces exhibit a high bidirectional elasticity (100% elongation in both directions) and a unit weight of 130 g/m$^2$.
- The textile is treated by padding with the solutions. It is subjected to drying at ambient temperature for a few minutes and is then heat treated at 180° C. for 2 minutes.
- The beading effect is measured by the Spray Test AATCC Test Method 22-1996. The test consists in spraying the sample of the textile article with a given volume of water. The appearance of the sample is subsequently evaluated visually and compared with the standards. A grade from 0 to 5 is assigned according to the amount of water retained. For 0, the sample is completely wet, for 5, the sample is completely dry.
- The oleophobic nature is measured by the standardized test (AATCC Test Method 118-1997) known under the name of "Oil repellency: Hydrocarbon Resistance Test". The "oil resistance test" consists in depositing drops of liquids with decreasing interfacial tensions on the textile and in determining the liquid LH starting from which spreading of the drops is observed. A grade of 0 to 8 is assigned depending on the LH obtained, 0 when liquid petrolatum spreads out (liquid paraffin, slight oleophobic nature), 3 when n-tetradecane spreads out (marked oleophobicity) and 8 when n-heptane no longer spreads out (very marked oleophobicity).

To test the longevity of the treatment, the samples are washed for 30 minutes in a continuous washing cycle at 50° C. in a commercial washing machine (Miele trade mark, Novotronic 824 model) in the presence of a standardized detergent (ECE Non-Phosphate Reference Detergent A—the formulation of which is given in BS1006: 1900: UK-T0) which corresponds to strong washing conditions. The amount of detergent used is 96 g (as the volume of water used by the machine is 12 l, this amount corresponds to a conventional concentration of 8 g/l). At the end of the cycle, 3 successive rinsing operations are carried out, followed by spin drying at 500 rev/min for 2 minutes. The textiles are subsequently dried in an oven at 150° C. for 1 min.

4) Experimental results:

| | | Before washing | | After washing | |
|---|---|---|---|---|---|
| Composition | Concentration | Debeading (Spray test) | Oil resistance test | Debeading (Spray test) | Oil resistance test |
| Pf | 2% | 3 | 6 | 1 | 2 |
| Pf | 6% | 4 | 7 | 1 | 2 |
| Pf | 10% | 5 | 8 | 1 | 2 |
| F1 | 6% | 4 | 0 | 2 | 0 |
| F1 + Pf | 2% + 2% | 5 | 7 | 3 | 2 |
| F1 + Pf | 6% + 2% | 5 | 8 | 3 | 6 |
| F1 + Pf | 10% + 2% | 5 | 8 | 3 | 6 |
| F2 | 8% | 3 | 0 | 2 | 0 |
| F2 + Pf | 8% + 2% | 4 | 8 | 3 | 7 |

The results show:

the poor longevity of the treatments carried out using the polyfluoroacrylate (Pf) alone;

the improvement in the oleophobic properties of the mixtures of silicone composition F1 or F2 and polyfluoroacrylate Pf;

the addition of the silicone composition makes it possible to reduce by a factor of 5 the amount of polyfluoroacrylate necessary in order to obtain the maximum grade in the oil resistance test, which constitutes a saving in cost insofar as polyfluoroacrylates are expensive;

the improvement in the longevity of the oil-repellent and water-repellent treatment with the mixtures combining silicone composition F1 or F2 and polyfluoroacrylate Pf.

It should be clearly understood that the invention defined by the appended claims is not limited to the specific embodiments indicated in the above description but encompasses the alternative forms thereof which depart neither from the scope nor from the spirit of the present invention.

The invention claimed is:

1. A crosslinkable liquid composition which crosslinks to give a hydrophobic and/or oleophobic silicone elastomer coating, comprising a polyorganosiloxane resin (component A) comprising, per molecule, at least two different siloxyl units selected from the group consisting of $(R^3)_3SiO_{0.5}$ (M unit), $(R^3)_2SiO$ (D unit), $R^3SiO_{1.5}$ (T unit), and $SiO_2$ (Q unit), wherein each $R^3$ is independently selected from the group consisting of a linear or branched $C_1$ to $C_6$ alkyl radical, a $C_2$ to $C_4$ alkenyl radical, a phenyl radical or a 3,3,3-trifluoropropyl radical, one of the units being a T unit or a Q unit, and at least three hydrolysable/condensable groups of OH and/or $OR^1$ types, where $R^1$ is a linear or branched $C_1$ to $C_6$ alkyl radical;

at least one component B, wherein component B comprises:

either component B-1, at least one metal alkoxide of general formula:

$$M[(OCH_2CH_2)_aOR^2]_n \quad (I)$$

in which:

M is a metal selected from the group consisting of: Ti, Zr, Ge, Si, Mn and Al;

n=valency of M;

the $R^2$ substituents, which are identical or different, each represent a linear branched $C_1$ to $C_{12}$ alkyl radical;

a represents zero, 1 or 2;

wherein when a represents zero, the alkyl radical $R^2$ has from 2 to 12 carbon atoms and, when a represents 1 or 2, the alkyl radical $R^2$ has from 1 to 4 carbon atoms;

optionally the metal M is connected to a ligand;

or component B-2, at least one metal polyalkoxide resulting from the partial hydrolysis of the monomeric alkoxides of formula (I) mentioned above in which $R^2$ has the abovementioned meaning with the symbol a representing zero;

or a combination of component B-1 and component B-2;

or component B-3, at least one optionally alkoxylated organosilane comprising, per molecule, at least one $C_2$-$C_6$ alkenyl group, component B 3/1, and/or at least one organosilicon compound comprising at least one epoxy, amino, ureido, isocyanato and/or isocyanurate radical, component B 3/2;

or component B-4, a combination of component B-1 with component B 3/1 and/or component B 3/2, a combination of component B-2 with component B 3/1 and/or component B 3/2, or a combination of component B-1 and component B-2 with component B 3/1 and/or component B 3/2; and a polyfluoroacrylate (component F).

2. The composition according to claim 1, furthermore comprising a functional additive, component C, comprising:

either component C-1, at least one silane and/or at least one polyorganosiloxane which is essentially linear and/or at least one polyorganosiloxane resin, each of these organosilicon compounds comprising, per molecule, with attaching functional group(s) capable of reacting with component A and/or component B or capable of generating, in situ, functional groups capable of reacting with component A and/or component B, and with applicational functional group(s);

or component C-2, at least one hydrocarbonaceous compound comprising at least one saturated or unsaturated, linear or branched hydrocarbonaceous group and optionally one or more heteroatom(s) other than Si and existing in the form of a monomeric, oligomeric or polymeric structure, the hydrocarbonaceous compound comprising, per molecule, with attaching functional group(s) capable of reacting with component A and/or component B or capable of generating, in situ, functional groups capable of reacting with component A and/or component B, and with applicational functional group(s);

or a mixture of component C-1 and component C-2.

3. The composition according to claim 1, comprising a polyfluoroacrylate comprising at least one polymer chain unit derived from a fluoroalkyl (meth)acrylate monomer.

4. The composition according to claim 3, comprising a polyfluoroacrylate comprising at least one polymer chain unit derived from a perfluoroalkyl (meth)acrylate monomer.

5. The composition according to claim 3, in which the polymer comprises at least one unit —C=O—O—$(CH_2)_n$—$(CF_2)_m$—$CF_3$, with n between 0 and 15, and m between 0 and 20.

6. The composition according to claim 3, in which the polyacrylate additionally comprises a polymer chain unit derived from an alkyl (meth)acrylate monomer.

7. The composition according to claim 6, in which the polyacrylate comprises at least one unit —C(=O)—O-(alkyl), with alkyl representing a linear, branched or cyclic alkyl having from 1 to 25 C.

8. The composition according to claim 3, in which the polyacrylate additionally comprises one or more polymer chain units derived from a (meth)acrylate monomer carrying one or more polar groups.

9. The composition according to claim 8, in which the polymer comprises one or more polar groups selected from amine, quaternary amine, alkyl or carboxylate groups or an anionic group having a counter-ion of ammonium, alkylammonium or alkali metal.

10. The composition according to claim 1, in which the proportion by weight of polyfluoroacrylate to the sum of the dry components A and B is between 1% and 99% by weight.

11. The composition according to claim 1, additionally comprising at least one component D which is an organic solvent or diluent and/or water.

12. A crosslinkable liquid composition, comprising component A—at least one polyorganosiloxane resin comprising, per molecule, at least two different siloxyl units selected from the group consisting of $(R^3)_3SiO_{0.5}$ (M unit), $(R^3)_2SiO$ (D unit), $R^3SiO_{1.5}$ (T unit), and $SiO_2$ (Q unit), wherein each $R^3$ is independently selected from the group consisting of a linear or branched $C_1$ to $C_6$ alkyl radical, a $C_2$ to $C_4$ alkenyl radical, a phenyl radical or a 3,3,3-trifluoropropyl radical, one of the units being a T unit or a Q unit, and at least three hydrolysable/condensable groups of OH and/or $OR^1$ types, where $R^1$ is a linear or branched $C_1$ to $C_6$ alkyl radical;

component B—at least one comprising:

component B-1, at least one metal alkoxide of general formula:

$$M[(OCH_2CH_2)_aOR^2]_n \quad (I)$$

in which:

M is a metal selected from the group consisting of: Ti, Zr, Ge, Si, Mn and Al;

n=valency of M;

the $R^2$ substituents, which are identical or different, each represent a linear branched $C_1$ to $C_{12}$ alkyl radical;

a represents zero, 1 or 2;

with the conditions according to which, when the symbol a represents zero, the alkyl radical $R^2$ has from 2 to 12 carbon atoms and, when the symbol a represents 1 or 2, the alkyl radical $R^2$ has from 1 to 4 carbon atoms;

optionally the metal M is connected to one or more ligands;

or component B-2, at least one metal polyalkoxide resulting from the partial hydrolysis of the monomeric alkoxides of formula (I) mentioned above in which the symbol $R^2$ has the abovementioned meaning with the symbol a representing zero;

or a combination of component B-1 and component B-2;

or component B-3, at least one optionally alkoxylated organosilane comprising, per molecule, at least one $C_2$-$C_6$ alkenyl group, component B 3/1, and/or at least one organosilicon compound comprising at least one epoxy, amino, ureido, isocyanato and/or isocyanurate radical, component B 3/2;

or component B-4, a combination of component B-1 with component B 3/1 and/or component B 3/2, a combination of component B-2 with component B 3/1 and/or component B 3/2, or a combination of component B-1 and component B-2 with component B 3/1 and/or component B 3/2;

component C—optionally at least one functional additive comprising:

either component C-1, at least one silane and/or at least one polyorganosiloxane which is essentially linear and/or at least one polyorganosiloxane resin, each of these organosilicon compounds comprising, per molecule, with attaching functional group(s) capable of reacting with component A and/or component B or capable of generating, in situ, functional groups capable of reacting with component A and/or component B, and with hydrophobicity functional group(s);

or component C-2 at least one hydrocarbonaceous compound comprising at least one saturated or unsaturated, linear or branched hydrocarbonaceous group and optionally one or more heteroatom(s) other than Si and existing in the form of a monomeric, oligomeric or polymeric structure, the hydrocarbonaceous compound comprising, per molecule, with attaching functional group(s) capable of reacting with component A and/or component B or capable of generating, in situ, functional groups capable of reacting with component A and/or component B, and with hydrophobic functional group(s);

or a mixture of component C-1 and component C-2;

component D—at least one non-reactive additive system comprising: (i) at least one organic solvent or diluent and/or one non-reactive organosilicon compound; (21) and/or water; and component F—a polyfluoroacrylate;

with, per 100 parts by weight of component A:

from 0.5 to 200 parts of component B, from 0 to 1,000 parts of component C, from 1 to 10,000 parts of component D.

13. The composition according to claim 1, wherein component A comprises a component A-3 which comprises a mixture:

of at least one resin comprising, in its structure, at least two different siloxyl units selected from the group consisting of M unit, D unit and T unit, at least one of these units being a T unit, it being possible for the OH and/or $OR^1$ groups to be carried by the M, D and/or T units and the content by weight of OH and/or $OR^1$ groups being between 0.2% and 10% by weight, and of at least one other resin comprising, in its structure, at least two different siloxyl units selected from the group consisting of M unit, D unit and T unit and Q unit, at least one of these units being a Q unit, it being possible for the OH and/or $OR^1$ groups to be carried by the M, D and/or T units and the content by weight of OH and/or $OR^1$ groups being between 0.2% and 10% by weight, the $R^3$ radicals present in these resins being identical or different and selected from $C_1$-$C_6$ alkyl radicals which are linear or branched, $C_2$-$C_4$ alkenyl radicals, the phenyl radical or the 3,3,3-trifluoropropyl radical.

14. The composition according to claim 1, in which the component B-1 comprises an alkyl titanate, an alkyl zirconate, an alkyl silicate or a mixture of at least two of them, and/or the component B-2 comprises a polytitanate originating from the partial hydrolysis of isopropyl, butyl or 2-ethylhexyl titanates, a polyzirconate originating from the partial hydrolysis of propyl and butyl zirconate, a polysilicate originating from the partial hydrolysis of ethyl and isopropyl silicate or a mixture of at least two of them.

15. The composition according to claim 14, in which the component B-1 comprises a compound selected from the group consisting of ethyl titanate, propyl titanate, isopropyl titanate, butyl titanate, 2-ethylhexyl titanate, octyl titanate, decyl titanate, dodecyl titanate, β-methoxyethyl titanate, β-ethoxyethyl titanate, β-propoxyethyl titanate or the titanate of formula $Ti[(OCH_2CH_2)_2OCH_3]_4$, propyl zirconate, butyl zirconate, methyl silicate, ethyl silicate, isopropyl silicate, n-propyl silicate, and mixtures of at least two of them.

16. The composition according to claim 2, in which the component C-1 comprises:

(i) an essentially linear diorganopolysiloxane comprising a hydroxyl group at each chain end, of formula:

(III)

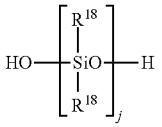

in which:

the $R^{18}$ substituents, which are identical or different, each represent a saturated or unsaturated, substituted or unsubstituted, aliphatic, cyclanic or aromatic monovalent $C_1$ to $C_{13}$ hydrocarbonaceous radical;

j has a value sufficient to confer, on the diorganopolysiloxane of formula (III), a dynamic viscosity at 25° C. ranging from 50 to 10,000,000 mPa·s; or (ii) a hydroxylated polyorganosiloxane resin comprising, in its structure, T and optionally M and/or optionally D siloxyl units; or (iii) a hydroxylated polyorganosiloxane resin capable of being obtained:

by hydrolysis of an alkoxysilane substituted by HFs;

by homocondensation of hydrolyzed silanes;

and by entrainment with steam of the hydrolysates deriving from the HFs; or (iv) a mixture of at least two of the compounds (I), (ii) and (iii).

17. The composition according to claim 16, comprising a hydroxylated MDT resin having a content by weight of OH group of from 0.2% to 10% by weight.

18. The composition according to claim 1, additionally comprising a polycondensation catalyst.

19. The composition according to claim 1, additionally comprising a filler.

20. A method of treating a textile material and conferring long-lasting oleophobicity and/or hydrophobicity properties thereon, the method comprising treating the textile material with the composition of claim 1 so that the composition is crosslinked around the constituent yarns, fibers and/or filaments of the textile material.

21. The method according to claim 20, in which the constituent yarns, fibers and/or filaments of the textile material are treated directly.

22. The method according to claim 20, in which the textile material is treated.

23. The method according to claim 20, in which the constituent yarns, fibers and/or filaments of the textile material are treated directly and then the textile material itself is treated directly.

24. The method according to claim 20, wherein the treatment results in the formation of a sheath of silicone elastomer around the constituent yarns, fibers and/or filaments of the textile material.

25. The composition according to claim 1, wherein $R^1$ is a linear or branched $C_1$ to $C_3$ alkyl radical.

26. The composition according to claim 2, wherein the at least one hydrocarbonaceous compound comprises one or more heteroatom(s) other than Si, and the one or more heteroatoms(s) comprises an oxygen, fluorine or nitrogen atom.

27. The composition according to claim 5, wherein in the at least one unit $—C{=}O—O—(CH_2)_n—(CF_2)_m—CF_3$, n is from 1 to 10, and m is between 1 and 20.

28. The composition according to claim 5, wherein in the at least one unit $—C{=}O—O—(CH_2)_n—(CF_2)_mCF_3$, n is from 1 to 4, and m is between 2 and 20.

29. The composition according to claim 5, wherein in the at least one unit $—C{=}O—O—(CH_2)_n—(CF_2)_m—CF_3$, n is 2, and m is between 3 and 12.

30. The composition according to claim 7, wherein alkyl in the at least one unit —C(=O)—O-(alkyl), represents from 1 to 9 C.

31. The composition according to claim 7, wherein the at least one unit —C(=O)—O-(alkyl), represents at least one unit Y':

$—C({=}O)—O—(CH_2)_p—CH_3$, with p between 0 and 24.

32. The composition according to claim 31, wherein p is between 1 and 15.

33. The composition according to claim 31, wherein p is between 1 and 8.

34. The composition according to claim 10, wherein the proportion by weight of polyfluoroacrylate to the sum of dry components A and B is between 5% and 80% by weight.

35. The composition according to claim 10, wherein the proportion by weight of polyfluoroacrylate to the sum of dry components A and B is between 10% and 60% by weight.

36. The composition according to claim 12, wherein the proportion by weight of polyfluoroacrylate to the sum of the dry components A, B and C is between 1% and 99% by weight.

37. The composition according to claim 12, wherein the proportion by weight of polyfluoroacrylate to the sum of the dry components A, B and C is between 5% and 80% by weight.

38. The composition according to claim 12, wherein the proportion by weight of polyfluoroacrylate to the sum of the dry components A, B and C is between 10% and 60% by weight.

39. The composition according to claim 12, wherein $R^1$ is a linear or branched $C_1$ to $C_3$ alkyl radical.

40. The composition according to claim 12, wherein the metal M is connected to one or more ligands, and the one or more ligands is obtained from β-diketone, β-ketoesters, malonic esters or triethanolamine.

41. The composition according to claim 40, wherein the metal M is connected to one or more ligands, and the one or more ligands is obtained from acetylacetone.

42. The composition according to claim 12, wherein the at least one hydrocarbonaceous compound comprises one or more heteroatom(s) other than Si, and the one or more heteroatoms(s) comprises an oxygen, fluorine or nitrogen atom.

43. The composition according to claim 12, wherein the composition comprises, per 100 parts by weight of component A:

from 0.5 to 100 parts of component B, from 1 to 1,000 of component C, from 1 to 5,000 parts of component D.

44. The composition according to claim 12, wherein the composition comprises, per 100 parts by weight of component A:

from 1 to 70 parts of component B, from 1 to 300 parts of component C, from 1 to 5,000 parts of component D.

45. A textile article, textile material or yarns, fibers and/or filaments for a textile material comprising a coating formed from the composition according to claim 1.

46. A textile article, textile material or yarns, fibers and/or filaments for a textile material comprising a coating formed from the composition according to claim 12.

* * * * *